United States Patent [19]

Brand et al.

[11] 4,289,247

[45] Sep. 15, 1981

[54] ARRANGEMENT FOR ARRESTING AND RELEASING AN INTERMEDIATE BUFFER COUPLING

[75] Inventors: Werner Brand, Leverkusen; Jaroslav Zavadil; Wolfgang Heuer, both of Düsseldorf, all of Fed. Rep. of Germany

[73] Assignee: Waggonfabrik Uerdingen AG, Düsseldorf, Fed. Rep. of Germany

[21] Appl. No.: 89,037

[22] Filed: Oct. 29, 1979

[30] Foreign Application Priority Data

Oct. 27, 1978 [DE] Fed. Rep. of Germany ..... 2846860

[51] Int. Cl.[3] ..... B61G 9/20

[52] U.S. Cl. ..... 213/20; 213/19; 213/74

[58] Field of Search ..... 213/12, 18–21, 213/71, 72, 74

[56] References Cited

U.S. PATENT DOCUMENTS

| | | | |
|---|---|---|---|
| 3,283,916 | 11/1966 | Cope | 213/20 X |
| 3,926,317 | 12/1975 | Scharfenberg et al. | 213/20 |
| 4,013,175 | 3/1977 | Klein et al. | 213/20 |

*Primary Examiner*—Randolph A. Reese

*Attorney, Agent, or Firm*—Michael J. Striker

[57] ABSTRACT

An arrangement for horizontal central arresting and releasing of an intermediate buffer coupling has a horizontally swingable coupling rod, a guide member at a rear end of the coupling rod and following the swinging of the latter, two rocking levers pivotally mounted on a vehicle and having abutment faces, a roller supported on the guide member and located between the rocking arms so as to abut against their abutment faces, and an actuating device connected with the rocking levers and operative for opening of the latter in the sense of allowing free movement of the intermediate buffer coupling.

7 Claims, 6 Drawing Figures

ARRANGEMENT FOR ARRESTING AND RELEASING AN INTERMEDIATE BUFFER COUPLING

BACKGROUND OF THE INVENTION

The present invention relates to an arrangement for arresting and releasing an intermediate buffer coupling, especially for rail vehicles. More particularly, it relates to an arrangement for arresting and releasing of an intermediate buffer coupling in which a guide is provided at a rear end of a coupling rod. The guide follows horizontal swinging movements of this rod and cooperates with parts mounted on the vehicle, via a roller.

Arrangements for arresting and releasing an intermediate buffer coupling, of the above-mentioned general type are known in the art. In a known arrangement, a guide formed as a cylindrical surface is connected with a coupling rod of an intermediate buffer coupling for joint rotation therewith, the cylindrical surface having an arresting recess. A housing which is held on the vehicle, has a pressure spring cooperating with a slide displaceably mounted in this housing and movable parallel by means of a rod. This slide carries a roller at its front end, the roller cooperating with the arresting recess of the cylindrical surface of the coupling rod in the sense of central arresting of the intermediate buffer coupling (Austrian Pat. No. 307,492). The slide and its guide require, for satisfactorily performing their functions, high structural expenditures and special maintenance. In addition to this, the given central arresting, in the case of movement of a second coupled vehicle, must be completely overcome, which leads to an increased wear of the arrangement and undesirably affects driving characteristics of the vehicle, for example, in that the rim pressure is increased.

SUMMARY OF THE INVENTION

Accordingly, it is an object of the present invention to provide an arrangement for arresting and releasing one intermediate buffer coupling, which avoids the disadvantages of the prior art.

More particularly, it is an object of the present invention to provide an arrangement for arresting and releasing an intermediate buffer coupling, which has a simple construction, is substantially wear-free, and particularly provides for free rotation of the intermediate buffer coupling in coupled condition.

In keeping with these objects and with others which will become apparent hereinafter, one feature of the present invention resides, briefly stated, in an arrangement in which a roller is mounted on a guide centrally of a coupling rod in a longitudinal direction and abuts against abutment faces formed on rocking levers which are pivotally mounted on a vehicle, the rocking arms being connected with an actuating device for their opening in the sense of allowing free movement of the intermediate buffer coupling.

The arrangement designed in accordance with the present invention is characterized by an especially simple construction. The guide on the coupling rod may be formed as a bearing block or support for the roller, and the rocking lever may be arranged in a bearing bush of a wear-free synthetic plastic material. The cooperation of the roller with the rocking arms provides for a release of the coupling in a greater region of swinging. Since the rocking arms are actuated by the actuating device, the releasing and arresting are inoperative against the desirable free swinging of the intermediate buffer coupling in coupled condition. Thereby the loading and the wear of the parts serving for these releasing and arresting are small, and favorable driving characteristics of the coupled vehicles are attained.

In order to guarantee small loading of the roller and the abutment faces of the rocking levers in the sense of an especially long maintenance-free operational time, it is provided in accordance with another feature of the present invention that the guide has two rollers each located at one side of the central longitudinal plane of the coupling rod and cooperating with a respective one of abutment faces formed on the rocking levers.

When the coupling to be arrested is subjected in operation to unusually high lateral forces, means is provided in accordance with still another feature of the present invention, for preventing overloading of the arrangement. This means includes spring members located between the actuating device and respective rocking levers and being under prestress, so that they rigidly act against an opening force applied by the actuating device, but resiliently takes up a lateral force acting upon the coupling and exceeding the prestress.

In order to make possible the utilization of the arrangement in electrically driven vehicles which do not have pneumatic or hydraulic means, the actuating device of the arrangement in accordance with a further feature of the present invention includes angle levers having a common axis of rotation with a crank rod of a crank unit which is driven from an electric motor. It is recommended to utilize variably high actuating forces of the crank unit by corresponding arrangement of the crank rods and the angle levers so that the rocking arm acts with a higher initial force from its closing position or its opening position. The electric motor of the actuating device may be controlled by contact pins provided on the heads of the intermediate buffer coupling.

In order to switch off the electric motor of the actuating device and to signal to a driver the position of the rocking levers by means of control lights, it is provided in accordance with still a further embodiment of the present invention that the electric motor or the crank unit have controlling means detecting a respective one of the end positions of the rocking levers.

In accordance with yet another feature of the present invention, the coupling rod, the rocking levers and the actuating device are mounted on a common frame connectable with the vehicle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
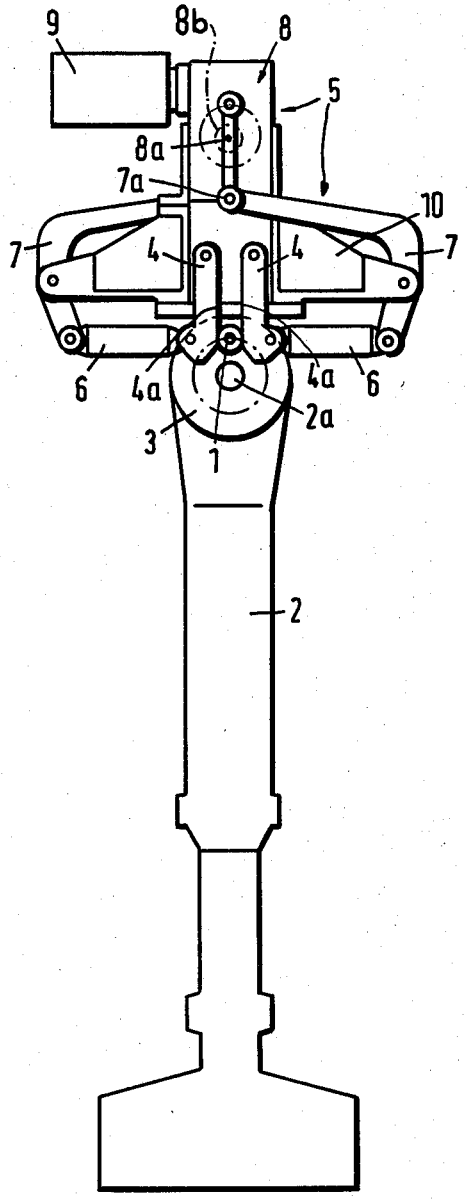
FIG. 1 is a plan view of an intermediate buffer coupling in arrested position.

An intermediate buffer coupling in accordance with the present invention has a guide 3 provided at a rear end of coupling arm 2, as shown in FIG. 1. A roller is supported by the guide 3. The roller 1 is located between abutment faces 4*a* of rocking levers 4. The rocking levers 4 are retained in the shown position by an actuating device 5, so that the intermediate buffer coupling is arrested in a central plane.

The actuating device 5 is composed, in the illustrated example, of spring members 6 which are under prestress, angle levers 7, a crank unit 8 with an upper crank rod 8*a* and a lower crank rod, and an electric motor 9 which can be replaced by a pneumatic drive or a hydraulic drive, in some cases. The angle levers 7 and the crank rods are connected with each other by a common axle 7*a* forming an axis of rotation. The spring members 6 serve for preventing overloading when a greater lateral force acts upon the arrested intermediate buffer coupling. They resiliently take up a force exceeding the prestress of the spring members. The spring members 6 in the sense of reliable opening of the rocking lever 4 operates rapidly against an opening force applied by the actuating device, that is in pulling direction.

When a vehicle is in coupled condition, the rocking levers are open, and thereby the intermediate buffer coupling can move freely about its coupling pin 2*a* in a horizontal plane. The coupling pin 2*a*, the rocking lever 4 and the actuating device 5 are held on a coupling frame 10 mountable on the vehicle.

Figure 2:
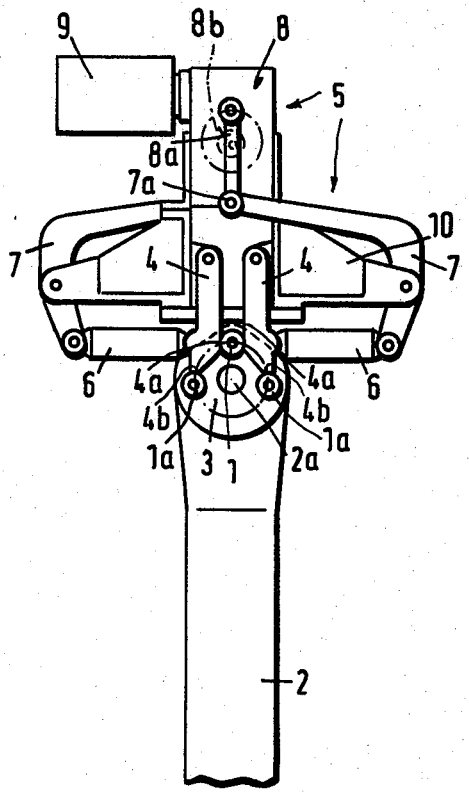
FIG. 2 is also a plan view of an intermediate buffer coupling in accordance with another embodiment of the present invention.
Figure 3:
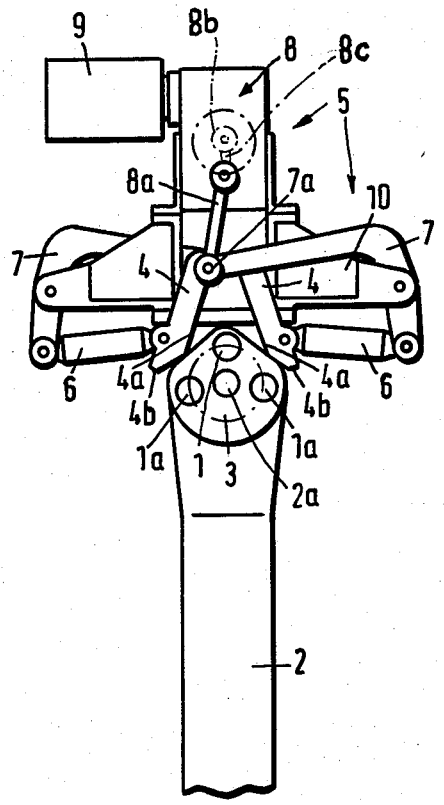
FIG. 3 is a view showing the coupling of FIG. 2 in its position of free movement.
Figure 4:
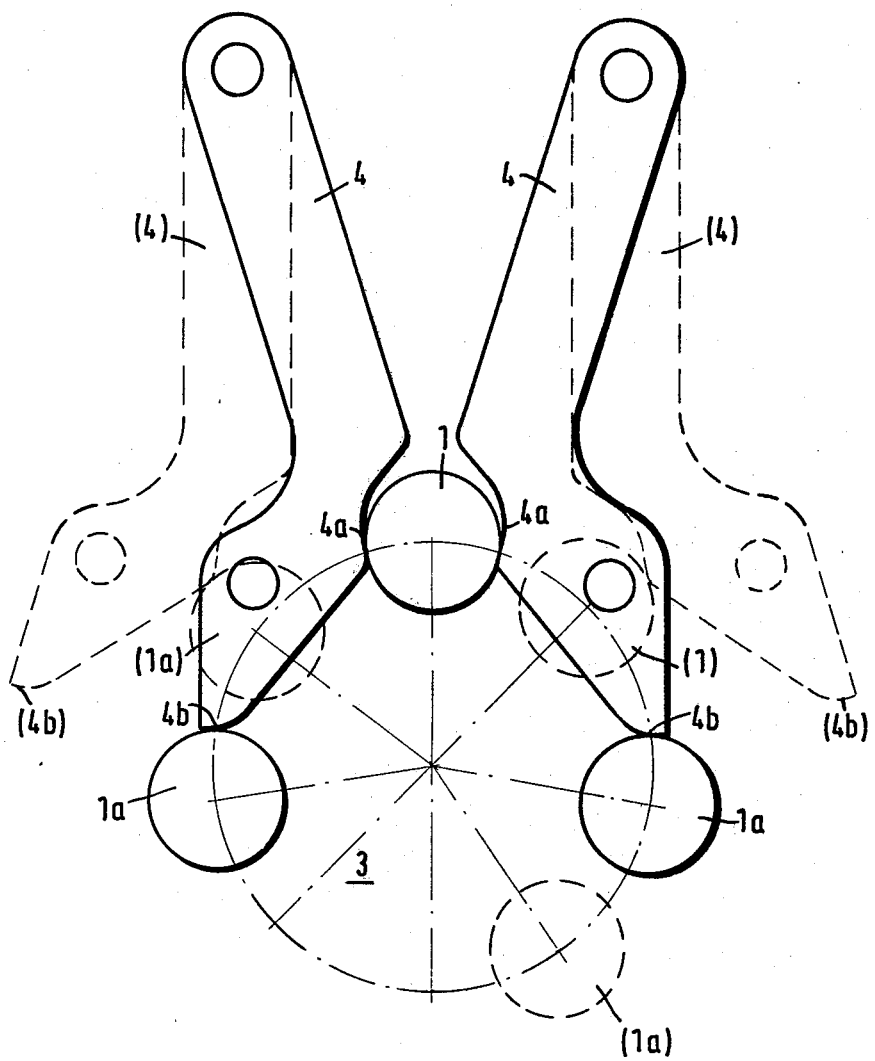
FIG. 4 is a view supplementary to the views of FIGS. 2 and 3 in larger scale and FIGS. 5 and 6 are a side view of an axial view of a controlling arrangement.

The intermediate buffer coupling shown in FIGS. 2–4 have a construction which mainly corresponds to the above-described construction. However, it distinguishes from the latter in that the guide 3 of the coupling rod 2 carries, in addition to the roller 1, two auxiliary rollers 1*a*. Each of the rocking levers 4 has an abutment face 4*b*. In the arresting position of the intermediate buffer coupling shown in FIGS. 2 and 4, the auxiliary rollers 1*a* of the guide 3 cooperate with the abutment faces 4*a* of the respective rocking levers 4. FIG. 4 in dash lines and FIG. 3 show the rocking lever 4 which is open for free movement of the intermediate buffer coupling.

Returning or releasing of the intermediate buffer coupling in the central plane is performed by the actuating device 5 and the rocking arm 4. For this purpose, one of the rocking levers 4 operates in the construction shown in FIG. 1, and two rocking levers operate in the construction shown in FIG. 4.

The electric motor 9 or the crank unit 8 may have controlling means for detecting a respective one of the end positions of the rocking levers 4. This allows a driver to determine the respective position of the rocking levers 4 and to switch off the electric motor. This means may be formed as a controller cylinder.

Figure 5:
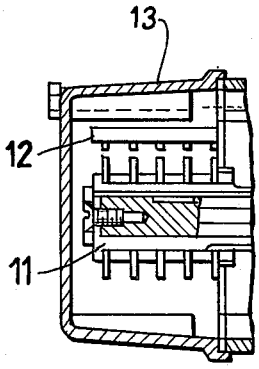
Figure 6:
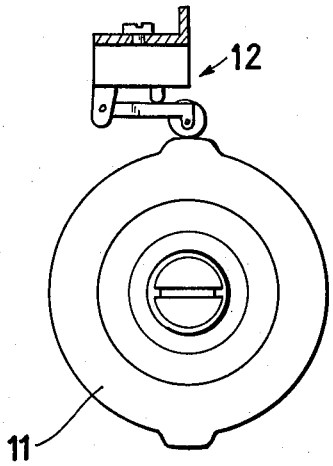

The crank rod 8*a* is connected with a shaft 8*b* of the crank unit 8 by a crank arm 8*c* at one end of the shaft 8*b*. The controlling cylinder 11 which has a plurality of cams, is mounted on the shaft 8*b* at the opposite axial end of the latter and cooperates with a switch 12 located in the housing 13 of the crank unit as shown in FIGS. 5 and 6. The controller cylinder is so arranged that the electric motor 9 is switched off in the position of the rocking lever shown in FIG. 2, on the one hand, and on in the position of this lever shown in FIG. 3, on the other hand.

It will be understood that each of the elements described above, or two or more together, may also find a useful application in other types of constructions differing from the types described above.

While the invention has been illustrated and described as embodied in an arrangement for arresting and releasing an intermediate buffer coupling, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An arrangement for horizontal central arresting and releasing of an intermediate buffer coupling, particularly for rail vehicles, the arrangement comprising in combination a horizontally swingable coupling rod having a central longitudinal plane and a rear end; a guide member provided at said rear end of said coupling rod and following the swinging of the latter; two rocking levers each pivotally mounted on a vehicle and having a first abutment face and a second abutment face; a roller supported on said guide member and located in said central longitudinal plane of said coupling rod and between said rocking levers so as to abut against said first abutment faces of the latter; said guide member being provided with two auxiliary rollers each located at the respective side of said central longitudinal plane and cooperating with a respective one of said second abutment faces; and an actuating device connected to said rocking levers and operative for opening of said rocking levers in the sense of allowing free movement of the intermediate buffer coupling.

2. The arrangement as defined in claim 1; and further comprising two spring members each connecting said actuating device with a respective one of said rocking levers and being prestressed, so that said spring members rigidly react to an opening force applied by said actuating device and resiliently takes up a lateral force acting upon the intermediate buffer coupling and exceeding the prestress.

3. An arrangement as defined in claim 2; and further comprising common means for mounting said coupling rod, said rocking arms and said actuating device together with each other.

4. An arrangement as defined in claim 3, wherein said common means is a frame element connectable with the vehicle.

5. An arrangement as defined in claim 1, wherein said arrangement includes an angle lever mountable on the vehicle and a crank unit including a crank rod, said angle lever and said crank rod being connected with one another for rotation about a common axis.

6. An arrangement as defined in claim 5; and further comprising means for driving said crank unit and including an electric motor.

7. An arrangement as defined in claim 6, wherein said crank unit and said electric motor form first and second drive means, respectively, said rocking levers having two end positions.

* * * * *